US005619394A

United States Patent [19]

Oros

[11] Patent Number: 5,619,394

[45] Date of Patent: Apr. 8, 1997

[54] LIMITED MOVEMENT COMPUTER KEYBOARD RETAINING ASSEMBLY

[75] Inventor: Donald L. Oros, Solon, Ohio

[73] Assignee: Elsag International N. V., Netherlands

[21] Appl. No.: 516,357

[22] Filed: Aug. 17, 1995

[51] Int. Cl.[6] ..... G06F 1/16; H05K 7/16

[52] U.S. Cl. ..... 361/680; 361/683; 400/682

[58] Field of Search ..... 361/679–683; 400/82, 488, 489, 682; 312/223.1, 223.2, 223.3, 208.1, 208.3; 364/708.1; G06F 1/16

[56] References Cited

U.S. PATENT DOCUMENTS

| | | | |
|---|---|---|---|
| 4,280,034 | 7/1981 | Ezaki et al. | 235/1 D |
| 4,330,776 | 5/1982 | Dennison, Jr. et al. | 340/365 R |
| 4,378,553 | 3/1983 | McCall | 340/365 R |
| 5,067,834 | 11/1991 | Szmanda et al. | 400/489 |
| 5,228,791 | 7/1993 | Fort | 400/489 |
| 5,267,127 | 11/1993 | Politt | 361/680 |

FOREIGN PATENT DOCUMENTS

| | | | |
|---|---|---|---|
| 55-102040 | 8/1980 | Japan | 341/22 |

*Primary Examiner*—Leo P. Picard
*Assistant Examiner*—Lynn D. Feild
*Attorney, Agent, or Firm*—Vytas R. Matas

[57] ABSTRACT

A computer keyboard retaining assembly having a removable peg mounted to the bottom of the keyboard and being insertable into a spring loaded peg holder mounted flush with a workstation work surface to allow rotational and lateral movement of the keyboard along the surface to optimally orient the keyboard with respect to the workstation operator while preventing the accidental dropping of the keyboard off the Workstation surface.

20 Claims, 4 Drawing Sheets

LIMITED MOVEMENT COMPUTER KEYBOARD RETAINING ASSEMBLY

BACKGROUND OF THE INVENTION

1. Field of the Invention

The present invention relates to computer keyboards generally and more particularly to retaining assemblies for allowing limited lateral and rotational movement of the keyboard on the computer work/station while preventing the accidental dropping of the keyboard off the computer workstation and the destruction thereof.

2. Description of the Prior Art

Distributed process control systems for sophisticated processes such as nuclear reactor control, automated manufacture of various products, power generation plant control, etc. require computers and their components such as keyboards to be of a much higher grade which translates into high cost for such components. Further, components such as keyboards are located at workstations proximate to the computer consoles and usually proximate to other workstations with other computer operators. These workstations are usually crowded with other peripheral material such as programming documentation booklets, etc.

This busy environment makes the possibility of these expensive keyboards being knocked off workstation tables and destroyed by either the computer operators or after work cleaning people a distinct reality. Thus, some retaining means is needed for affixing such keyboards to the workstation table while allowing the operator to laterally and rotationally move the keyboard on the workstation surface to position it to his liking. To date no such keyboard retaining means are known.

Laptop computers are known to have keyboards which are removable from their fixed location proximate to the monitor. An example of such may be seen in U.S. Pat. No. 5,132,876 and U.S. Pat. No. 5,319,582. However, it will be seen that neither reference provides any teaching of coupling this removed keyboard to a workstation table in a manner allowing lateral and rotational movement.

Keyboard support table are known which retain the keyboard on the table by resting it against a palm holder affixed to the table. An example of such is found in U.S. Pat. No. 5,074,511. However, there is no provision for rotatably moving the keyboard on the table and while the keyboard is prevented from dropping off the front of the table there is nothing to prevent the lateral movement of the keyboard off the side of the table.

Thus it is seen that a keyboard retainer was needed to prevent the keyboard from being dropped off the workstation table while allowing limited lateral and rotational movement on the workstation table.

BRIEF SUMMARY OF THE INVENTION

The present invention solves the mentioned problems associated with prior art keyboard retainers as well as others by mounting a keyboard to the workstation table by a turnable removable peg on the bottom of the keyboard. The peg or stud is captured within a spring loaded socket mounted on the computer workstation table to allow the keyboard to be rotatable on the workstation table while preventing the keyboard from being laterally knocked off the table. Some lateral movement may be provided by having the socket formed as an extended oval to allow the stud to laterally move along the oval as well as to rotate on the table.

By removing the threaded peg from the keyboard, it can be placed and moved anywhere on the table.

In view of the foregoing it will be seen that one aspect of the present invention is to provide a keyboard retaining assembly that prevents the keyboard from being dropped from the workstation table.

Another aspect of the present invention is to provide a keyboard retaining assembly for affixing the keyboard to the workstation while allowing rotational movement of the keyboard along the workstation table surface.

Yet another aspect of the present invention is to provide a keyboard retaining assembly for affixing the keyboard to the workstation while allowing both lateral and rotational movement of the keyboard along the workstation table surface.

These and other aspects of the present invention will be more fully understood upon a review of the following description of the preferred embodiment when considered with the accompanying drawings.

DETAILED DESCRIPTION OF THE PREFERRED EMBODIMENT

Turning now to the Applicant's description of his preferred embodiment it will be understood that the mentioned embodiment is being disclosed herein not to limit the Applicant's invention thereto but to provide a description of one way of utilizing the Applicant's invention.

Figure 1:
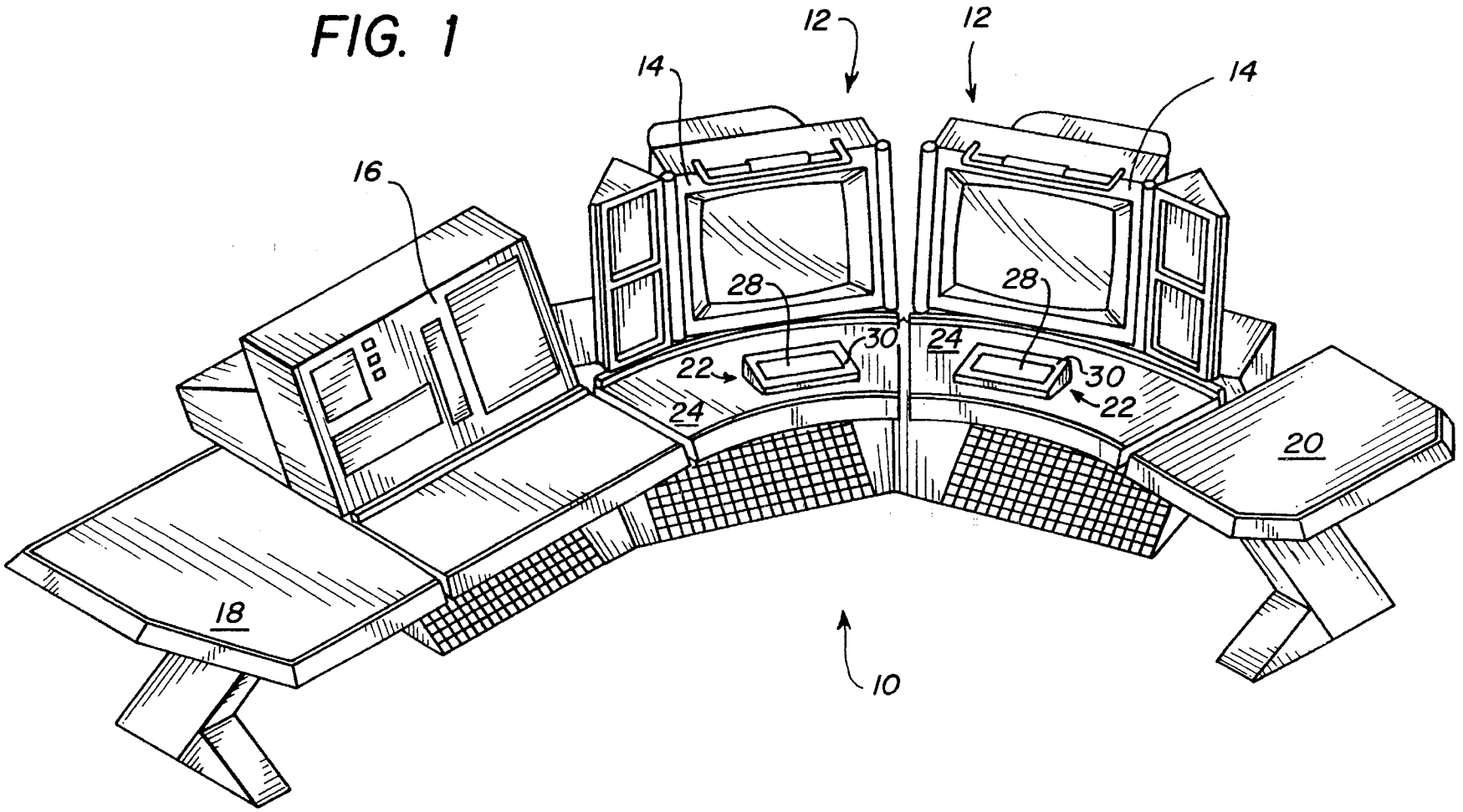
FIG. 1 is a perspective view of the computer workstation showing the keyboard mounted thereto by the retaining assembly of the present invention.

With particular reference to FIG. 1., a process control operator workstation (10) is shown which utilizes a pair of ergonomically designed console assemblies (12) along with other consoles all configured into a semi-circular array around the operator (not shown) who is normally seated in front of the video display monitors (VDM) (14) located on the console assembly (12). The other consoles appearing in the semi-circular array include an auxiliary equipment bay (16) mounted proximately to one of the ergonomic console assemblies (12) and a pedestal table (18) along with a drawer table (20) mounted at opposite ends of the semi-circular array.

The console assembly (12) also has a keyboard (22) located on the work shelf (24) which is mounted thereto by a retaining assembly (26) best seen in FIGS. 3 through 6, which allows the keyboard assembly (22) to be retained on the work shelf (24) to prevent it from being knocked off therefrom and destroyed while still allowing rotational movement of the keyboard assembly (22) thereon.

Figure 3:
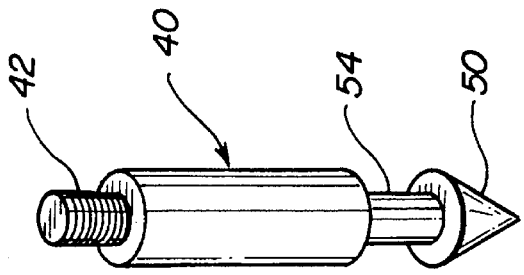
FIG. 3 is a perspective view of the peg used to couple the keyboard to the retaining assembly of the present invention.
Figure 2:
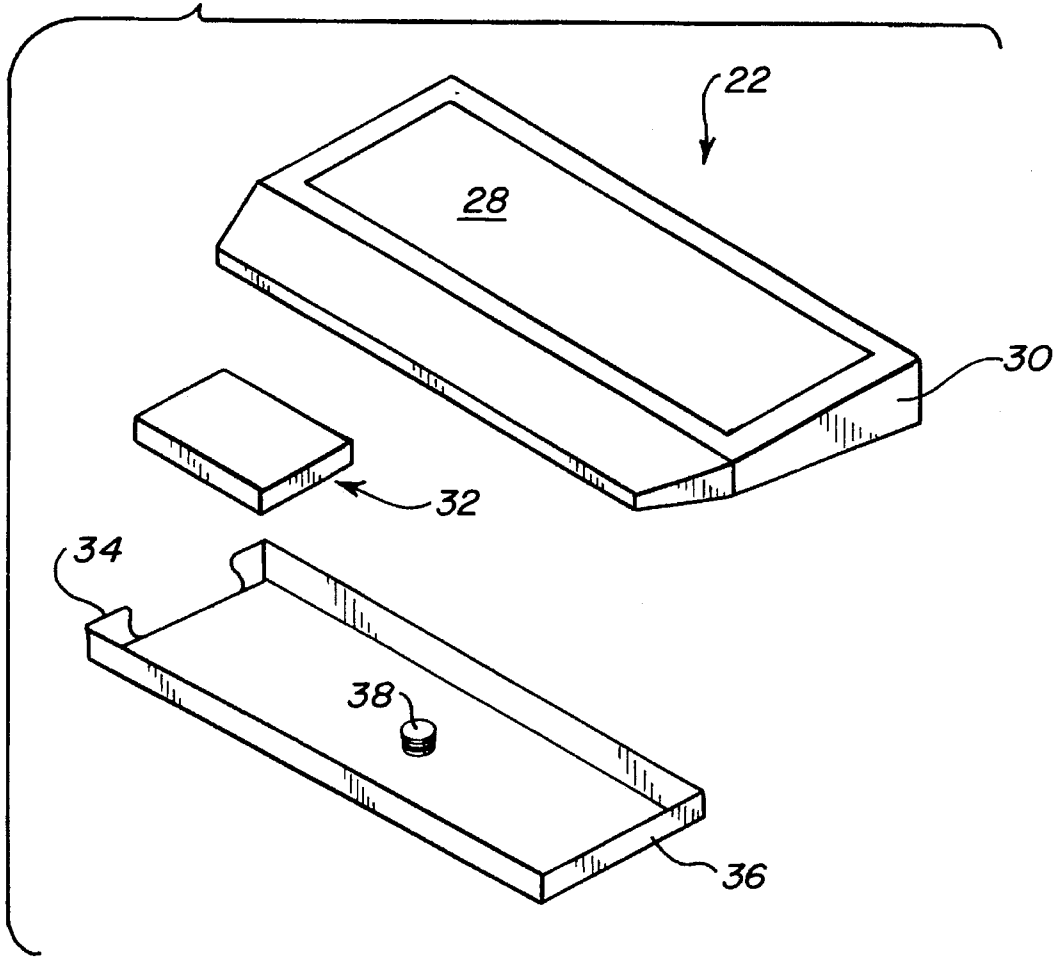
FIG. 2 is a perspective view of the main keyboard assembly parts showing the threaded hole at the bottom thereof for mounting the keyboard to the retaining assembly of the present invention.

As is best seen in FIGS. 2 and 3, the keyboard assembly (22) has a keyboard membrane (28) mounted to a top cover (30) containing all the requisite alphanumeric, numeric and other function keys found in process system control keyboards. A floppy drive assembly (32) is located on a notched side (34) of a keyboard base (36) which contains the needed electrical circuitry (not shown) for the floppy drive assembly (32) and the membrane 28. The keyboard assembly 22 is assembled together in a known manner and provides a communication link to the workstation by way of known electrical connections (not shown).

The keyboard base (36) has a threaded insert (38) mounted therein into which a stud or pin (40) may be attached by rotating the threaded end (42) of the pin (40) into the insert (38) to have the pin (40) extend out from the bottom of the base (36) to be engaged into the retainer assembly (26) in a manner which will be described later.

Clearly, if the operator wishes to have the keyboard assembly (22) freely move along the surface (24), he merely removes the pin (40) from the keyboard assembly (22) assuming the risk of the keyboard being knocked off the workstation (10).

Figure 4:
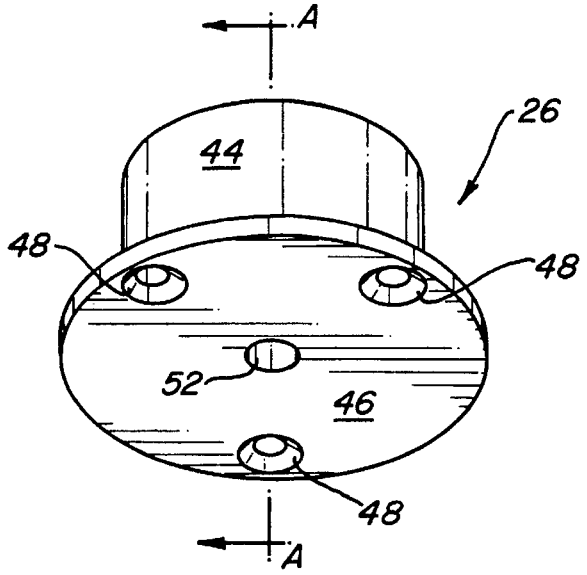
FIG. 4 is a perspective view of the retaining assembly of the present invention.
Figure 5:
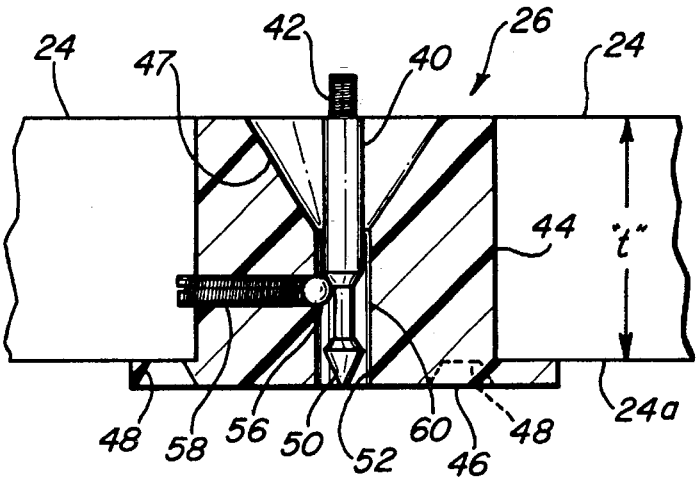
FIG. 5 is a cut-away view along section A—A of the FIG. 4 assembly shown mounted on the workstation table.
Figure 6:
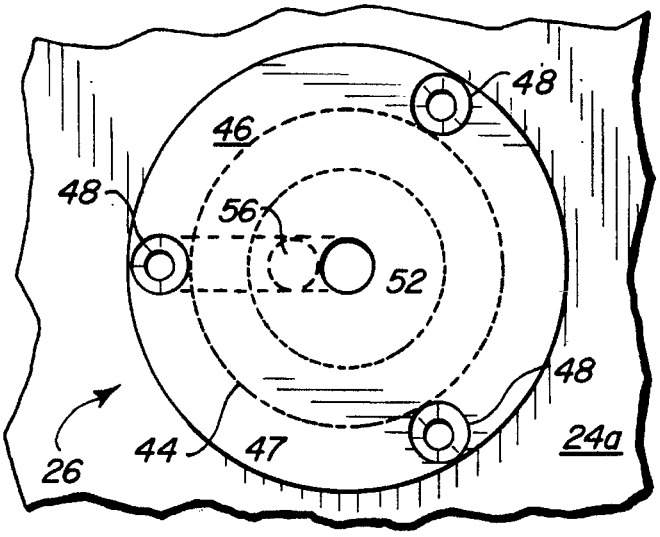
FIG. 6 is a bottom view of the FIG. 5 assembly.

Turning next to FIG. 4–6 it will be seen that the retaining assembly (26) is formed to have a cylindrical body (44) whose height matches the wall thickness "t" of the work shelf (24) of the workstation(10). Thus the body (44) may be flush mounted to the work surface (24) through an appropriately located hole in the surface (24). The assembly (26) has a base (46) radially larger than the cylinder (44) with every spaced tapered mounting holes (48) along the periphery to allow the assembly (26) to be affixed by screws (not shown) extending these through into the bottom (24*a*) of the work shelf (24) as best seen in FIGS. 5 and 6.

The pin (40) with the keyboard (22) mounted thereto through the threaded section (42) is then inserted into a tapered portion (48) of the assembly (26) until the tip (50) of pin (40) rests in a central aperture (52) of the assembly (26). This aligns a narrow neck (54) of the assembly (26) with a ball (56) which is spring (58) loaded to capture the neck (54)within a narrow tunnel portion (60) of the assembly (26). The pin (40) now rests in the assembly (26) pivoted at tip (50) in the central aperture (52). The neck (54) being smaller than the tunnel portion (60) allows the pin (40) and the keyboard (22) attached thereto to be easily rotated within the assembly (26) while locking the pin (40) and keyboard to the surface (24) by the ball (56) pressing into the neck portion (54). Thus the keyboard (22) is free to rotate on the surface (24) but is prevented from being knocked off the same surface.

Figure 9:
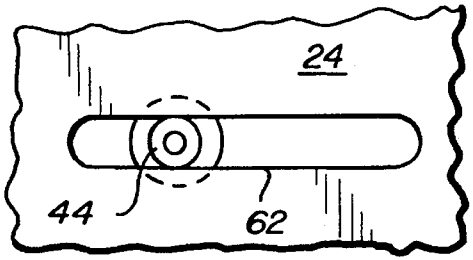
FIG. 9 is a top view of the workstation table having a groove therein for various lateral retaining assembly positions.
Figure 9A:
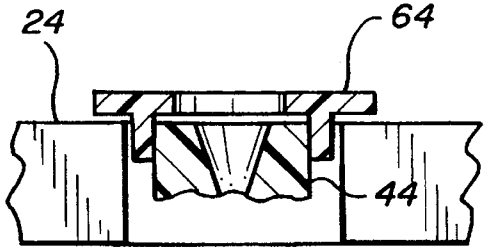
FIG. 9*a* is an expanded view of the FIG. 9 assembly showing the locking of the retainer assembly in place by a cap thereon.

As best seen in FIG. 9 lateral movement may be added to the assembly (26) by cutting an elongated oval aperture (62) into the surface (24) instead of a circular one matching the cylindrical portion of the assembly (26). The aperture width will match the cylindrical portion (44) and allow it to be moved anywhere along this aperture (62). When a location is selected the assembly may be fastened in place by any desired fastening means. One way would be to press or screw a cap (64) over the cylindrical portion (44) which would extend over the aperture (62) and capture the assembly (26) therein by virtue of the enlarged bottom portion (26) and the cap (64).

Figure 7:
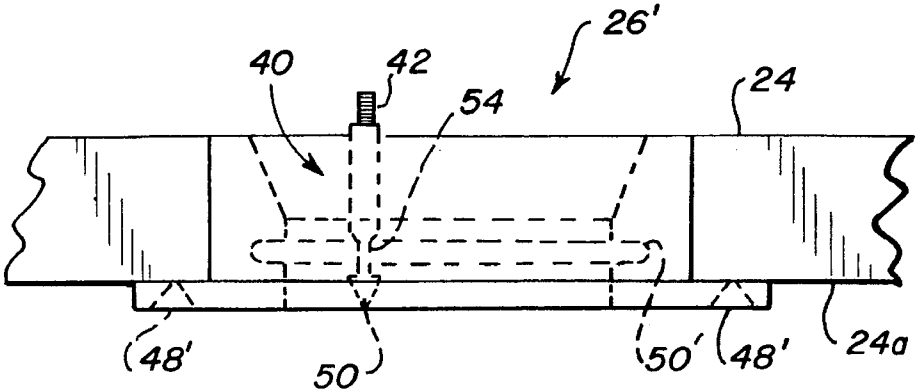
FIG. 7 is a side view of another embodiment of the retaining assembly of the present invention.
Figure 8:
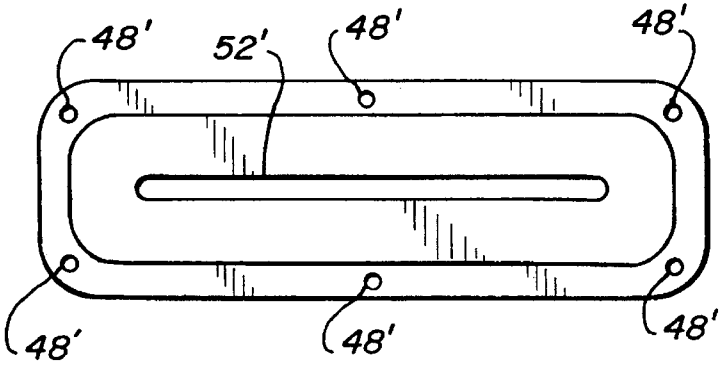
FIG. 8 is a bottom view of the FIG. 7 assembly.

FIGS. 7–8 show another embodiment wherein lateral motion may be added to rotational provided by the assembly (26). In this embodiment, an elongated oval assembly (26) is shown which in effect stretches the socket of the assembly (26) into an oval. The spring loaded plunger (50) of the assembly (26) is replaced with an elastic rubber oval (50') to fit against the neck (54) of the pin (40). The tip 50 of the pin 40 thus is free to laterally move along the oval bottom aperture (52') while allowing rotational movement as was described earlier.

Certain modifications and additions have been deleted herein for the sake of conciseness and readability but are fully intended to be within the scope of the following claims.

What is claimed is:

1. A keyboard retaining assembly for movably mounting the keyboard to a work surface of a computer workstation comprising:

a peg connected to a bottom surface of the keyboards; retaining means for capturing said peg therein;

a computer workstation work surface having said retaining means affixed thereto to allow said peg and the keyboard connected thereto to be movably mounted flush with said work surface;

said retaining means allowing the rotational movement of said peg therein and the rotational movement of the keyboard connected to said peg along said work surface and has a first peg holder section mounted into said work surface to be flush with said work surface and an enlarged bottom section connected to said peg holder section for capturing said retaining means to this bottom of said work surface; and said peg holder section being formed to have a tapered inlet leading to a narrow opening having a spring loaded retainer extending there into and said peg has a recessed area there along for interference fitting with said retainer when said peg is inserted into said retaining means.

2. A keyboard assembly as set forth in claim 1 wherein said holder section is formed as a cylindrical section having an enlarged bottom section for mounting said cylindrical holder to the bottom of said work surface.

3. A keyboard assembly as set forth in claim 2 wherein said work surface has an elongated groove formed therein for laterally moving said peg holder section there along.

4. A keyboard assembly as set forth in claim 3 including a cap section fitting over the top of said retainer means to capture said retainer means inside said work surface between said cap section and said enlarged section at a predetermined position along said elongated groove.

5. A keyboard assembly as set forth in claim 4 wherein said cap section is pressed over the top of said retainer means.

6. A keyboard assembly as set forth in claim 4 wherein the top of said retainer means is threaded and said cap section has complimentary threads on the inside thereof to allow said cap section to be screwed onto the top of said retaining means.

7. A retaining assembly for holding a keyboard mounted thereto while allowing limited motion of the keyboard comprising;

a peg connected to a bottom surface of the keyboard;

retainer means for capturing said peg therein while allowing rotation of said peg therein and rotation of the keyboard attached thereto;

means for mounting said retainer assembly to a surface locating the keyboard thereon;

said retaining means comprising a first peg holder section mounted into said work surface to be flush with said work surface and an enlarged bottom section connected to said peg holder section for capturing said retaining means to the bottom of said work surface; and said peg holder section being formed to have a tapered inlet leading to a narrow opening having a spring loaded retainer extending there into and said peg has a recessed area there along for interference fitting with said retainer when said peg is inserted into said retaining means.

8. A retaining assembly as set forth in claim 7 wherein said holder section is formed as a cylindrical section having an enlarged bottom section for mounting said cylindrical holder to the bottom of said work surface.

9. A retaining assembly as set forth in claim 7 wherein said work surface has an elongated groove formed therein for laterally moving said peg holder section there along.

10. A retaining assembly as set forth in claim 9 including a cap section fitting over the top of said retainer means to capture said retainer means inside said work surface between said cap section and said enlarged section at a predetermined position along said elongated groove.

11. A keyboard retaining assembly for movably mounting the entire keyboard assembly to a work surface of a computer workstation comprising:

a removable peg connected to a bottom surface of the keyboard assembly;

retaining means for capturing said peg therein; and a computer workstation work surface having said retaining means affixed thereto to allow said peg and the keyboard connected thereto to be movably mounted flush with said work surface to allow the entire keyboard assembly to be moved along the work surface of the workstation.

12. A keyboard assembly as set forth in claim 11 wherein said retaining means allows the rotational movement of said peg therein and the rotational movement of the keyboard connected to said peg along said work surface.

13. A keyboard assembly as set forth in claim 12 wherein said retaining means allows the translational movement of said peg therein and the translational movement of the keyboard connected to said peg along said work surface.

14. A keyboard assembly as set forth in claim 12 wherein said retaining means comprises a first peg holder section mounted into said work surface to be flush with said work surface and an enlarged bottom section connected to said peg holder section for capturing said retaining means to the bottom of said work surface.

15. A keyboard assembly as set forth in claim 14 wherein said retaining means is formed as all elongated oval to allow said peg to laterally move there along.

16. A keyboard assembly as set forth in claim 15 wherein said retaining means includes an elongated resilient gasket mounted therein to provide an interference fit with said peg to allow movement of said peg there along while maintaining it in the last position said peg was moved to.

17. A retaining assembly for holding a keyboard assembly mounted thereto while allowing limited motion of the entire keyboard assembly comprising;

a peg removably connected to a bottom surface of the keyboard assembly; and retainer means for capturing said peg therein while allowing rotation of said peg therein and rotation of the entire keyboard assembly attached thereto; and means for mounting said retainer assembly to a surface locating the keyboard assembly thereon for limited movement there along.

18. A retaining assembly as set forth in claim 17 wherein said retaining means comprises a first peg holder section mounted into said work surface to be flush with said work surface and an enlarged bottom section connected to said peg holder section for capturing said retaining means to the bottom of said work surface.

19. A retaining assembly as set forth in claim 18 wherein said retainer means is formed as an elongated oval to allow said peg to laterally move there along.

20. A retaining assembly as set forth in claim 19 wherein said retaining means includes an elongated resilient gasket mounted therein to provide an interference fit with said peg to allow movement of said peg there along while maintaining it in the last position said peg was moved to.

* * * * *